US007097511B1

(12) United States Patent
Chen et al.

(10) Patent No.: US 7,097,511 B1
(45) Date of Patent: Aug. 29, 2006

(54) STRUCTURE FOR SIM CARD ASSEMBLY AND DISASSEMBLY

(75) Inventors: Chao Chen, Waterloo (CA); Timothy H. Kyowski, Brantford (CA)

(73) Assignee: Research In Motion Limited, Ontario (CA)

( * ) Notice: Subject to any disclaimer, the term of this patent is extended or adjusted under 35 U.S.C. 154(b) by 0 days.

(21) Appl. No.: 11/186,544

(22) Filed: Jul. 21, 2005

(51) Int. Cl.
*H01R 24/00* (2006.01)

(52) U.S. Cl. ..... 439/630; 439/159

(58) Field of Classification Search ..... 439/630, 439/159, 328, 945; 361/737; 235/441
See application file for complete search history.

(56) References Cited

U.S. PATENT DOCUMENTS

| | | | | |
|---|---|---|---|---|
| 6,062,887 | A * | 5/2000 | Schuster et al. | 439/218 |
| 6,129,572 | A | 10/2000 | Feldman et al. | 439/328 |
| 6,655,590 | B1 * | 12/2003 | McFeely et al. | 235/451 |
| 6,932,652 | B1 * | 8/2005 | Chen | 439/630 |
| 6,932,654 | B1 * | 8/2005 | Washino | 439/630 |
| 6,935,898 | B1 * | 8/2005 | Lai | 439/630 |
| 6,967,848 | B1 * | 11/2005 | Klatt et al. | 361/759 |
| 7,004,770 | B1 * | 2/2006 | Wu | 439/159 |

FOREIGN PATENT DOCUMENTS

GB 2 328 772 A 3/1999

* cited by examiner

*Primary Examiner*—Michael C. Zarroli
(74) *Attorney, Agent, or Firm*—Brij K. Aqarwal; Eckert Seamans Cherin & Mellott, LLC

(57) ABSTRACT

A smart card holder frame for an electronic device which comprises a card holder, a member, and an alignment structure. The card holder has a base, a first wall, a second wall, a connector clip, and an open region structured to receive a smart card therein, the open region being disposed between the base, the first wall, the second wall, and the connector clip. The member has a first sloped surface and a second sloped surface structured to be engaged with a smart card and to align the smart card with the open region. The alignment structure comprises a deflectable finger that is structured to bias the smart card into engagement with at least one of the first sloped and the second sloped surface, wherein the alignment structure is adjacent the card holder and wherein the member is adjacent the card holder and the alignment structure.

24 Claims, 8 Drawing Sheets

STRUCTURE FOR SIM CARD ASSEMBLY AND DISASSEMBLY

BACKGROUND OF THE INVENTION

1. Field of the Invention

The invention relates generally to electronic devices having a smart card therein and, more particularly, to a handheld electronic device that facilitates the assembly and/or disassembly of a smart card.

2. Background Information

Numerous types of handheld electronic devices are known. Examples of such handheld electronic devices include, for instance, personal data assistants (PDAs), handheld computers, two-way pagers, cellular telephones, and the like. Many handheld electronic devices also feature wireless communication capability, although many such handheld electronic devices are stand-alone devices that are functional without communication with other devices.

Such handheld electronic devices are generally intended to be portable, and thus are of a relatively compact configuration in which keys and other input structures often perform multiple functions under certain circumstances or may otherwise have multiple aspects or features assigned thereto. With advances in technology, handheld electronic devices are built to have progressively smaller form factors yet have progressively greater numbers of applications and features resident thereon.

Many handheld electronic devices incorporate smart cards therein. The smart card may contain electronic memory and possibly an embedded integrated circuit (IC). One type of smart card is a subscriber identity module (SIM) card. A SIM card may be used, for example, in a digital or cellular wireless communication device to encrypt voice and data transmissions. The SIM card may also store data about the device user so that a digital or cellular network can identify and authenticate the user when the network is accessed. Additionally, the SIM card may be used to store the user's personal settings (such as phone numbers, display settings, ring tone settings, etc.).

Many handheld electronic devices are designed such that the SIM card can be removed by a user. Thus, multiple SIM cards can be swapped into a single handheld electronic device and/or a single SIM card can be swapped between multiple handheld electronic devices. For example, a user may employ a single handheld electronic device for both business and personal communication. Accordingly, a user can assemble (i.e., insert) a first SIM card containing the user's business settings and/or data into the handheld electronic device when conducting a business transaction (e.g., a phone call). After finishing the business transaction, the user can disassemble (i.e., remove) the first SIM card and assemble a second SIM card containing the user's personal settings and/or data into the handheld electronic device before conducting a personal transaction.

Due the reduced size of handheld electronic devices and SIM cards, however, assembly and disassembly of the SIM cards can be problematic. During assembly, for example, a user may not be able to properly align the SIM card within the handheld electronic device's SIM card holder frame thus making proper seating of the SIM card difficult if not impossible. During disassembly, a user may not be able to easily grasp the SIM card after it has been unseated from the SIM card holder frame. A user may be forced to flip over the handheld electronic device so that the SIM card falls away from the device, which increases the risk that the SIM card will be dropped and damaged.

Thus, a need exists for a handheld electronic device that facilitates the assembly and/or disassembly of a smart card.

SUMMARY OF THE INVENTION

One aspect of the disclosure relates to a smart card holder frame for an electronic device comprising a card holder, a member, and an alignment structure. The card holder has a base, a first wall, a second wall, a connector clip, and an open region structured to receive a smart card therein, the open region being disposed between the base, the first wall, the second wall, and the connector clip. The member has a first sloped surface and a second sloped surface structured to be engaged with a smart card and to align the smart card with the open region. The alignment structure comprises a deflectable finger that is structured to bias the smart card into engagement with at least one of the first sloped and the second sloped surface, wherein the alignment structure is adjacent the card holder and wherein the member is adjacent the card holder and the alignment structure.

Another aspect of the disclosure relates to a handheld electronic device which comprises a processor unit having a processor, an input apparatus, an output apparatus, and a memory including a smart card and a housing adapted to carry the processor unit, the housing including a smart card holder frame. The smart card holder frame comprises a card holder, a member, and an alignment structure. The card holder has a base, a first wall, a second wall, a connector clip, and an open region structured to receive a smart card therein, the open region being disposed between the base, the first wall, the second wall, and the connector clip. The member has a first sloped surface and a second sloped surface structured to be engaged with a smart card and to align the smart card with the open region. The alignment structure comprises a deflectable finger that is structured to bias the smart card into engagement with at least one of the first sloped and the second sloped surface, wherein the alignment structure is adjacent the card holder and wherein the member is adjacent the card holder and the alignment structure.

BRIEF DESCRIPTION OF THE DRAWINGS

A full understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

Figure 1:
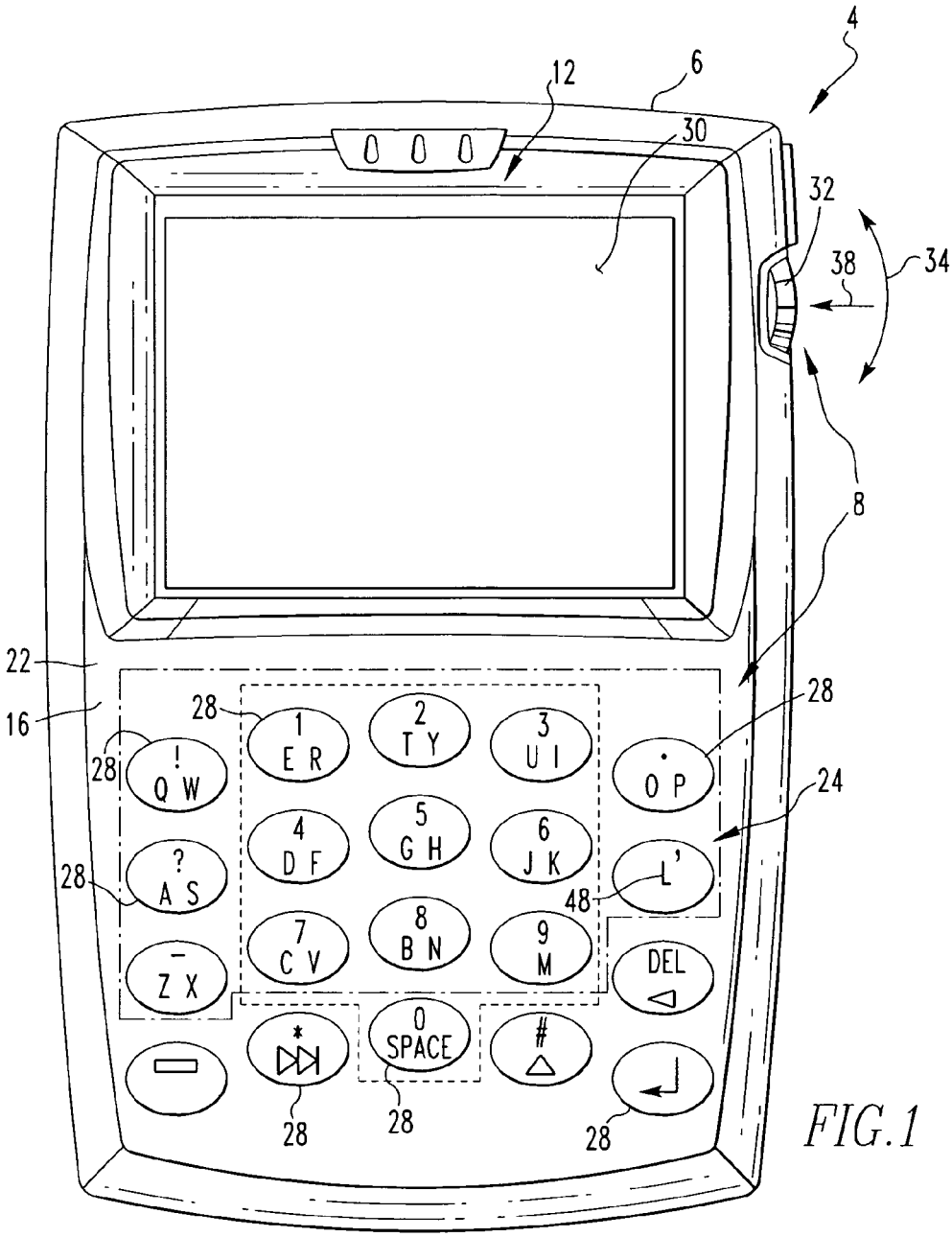
FIG. 1 is a top plan view of an improved handheld electronic device in accordance with one embodiment.

Directional phrases used herein, such as, for example, left, right, up, down, top, bottom, side, clockwise, counterclockwise, and derivatives thereof, relate to the orientation of the elements shown in the drawings and are not limiting upon the claims unless expressly recited therein. Additionally, as employed herein, the expression "a number of" and variations thereof shall refer broadly to any quantity, including a quantity of one.

Figure 2:
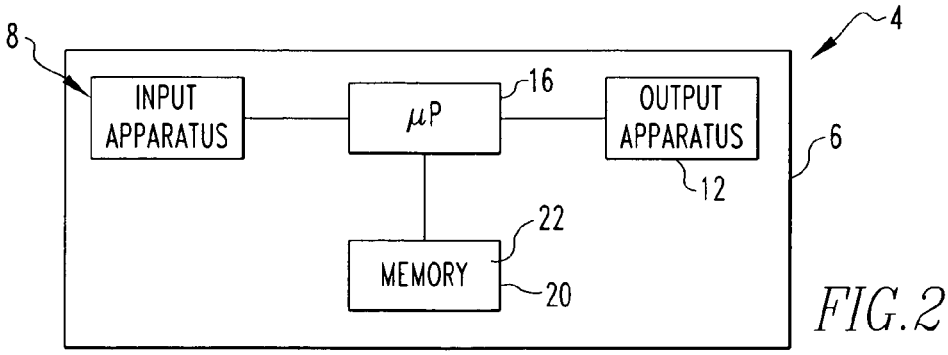
FIG. 2 is a schematic depiction of the improved handheld electronic device of FIG. 1.

An improved handheld electronic device 4 is indicated generally in FIG. 1 and is depicted schematically in FIG. 2. The exemplary handheld electronic device 4 includes a housing 6 upon which are disposed a processor unit that includes an input apparatus 8, an output apparatus 12, a processor 16, and a memory 20. The housing 6 is adapted to carry the processor unit. In the current embodiment, the housing 6 includes a smart card holder frame 50 (not shown in FIG. 1). The processor 16 may be, for instance and without limitation, a microprocessor (μP) and is responsive to inputs from the input apparatus 8 and provides output signals to the output apparatus 12. The processor 16 also interfaces with the memory 20. Examples of handheld electronic devices are included in U.S. Pat. Nos. 6,452,588 and 6,489,950, the disclosures of which are incorporated by reference herein.

As can be understood from FIG. 1, the input apparatus 8 includes a keypad 24 and a thumbwheel 32. The keypad 24 is in the exemplary form of a reduced QWERTY keyboard including a plurality of keys 28 that serve as input members. The keys 28 are disposed on a front face of the housing 6, and the thumbwheel 32 is disposed at a side of the housing 6. The thumbwheel 32 can serve as another input member and is both rotatable, as is indicated by the arrow 34, to provide inputs to the processor 16, and also can be pressed in a direction generally toward the housing 6, as is indicated by the arrow 38, to provide other input to the processor 16. The output apparatus 12 includes a display 30 for displaying text, graphics, video, etc.

The memory 20, depicted schematically in FIG. 2, can be any of a variety of types of internal and/or external storage media such as, without limitation, RAM, ROM, EPROM(s), EEPROM(s), and the like that provide a storage register for data storage such as in the fashion of an internal storage area of a computer, and can be volatile memory or nonvolatile memory. In the current embodiment, at least a portion of the storage media is incorporated within a smart card 11 (e.g., a SIM card) that interfaces with the processor 16. The memory 20 may include a number of routines depicted generally with the numeral 22 for the processing of data. The routines 22 can be in any of a variety of forms such as, without limitation, software, firmware, and the like.

Figure 3:
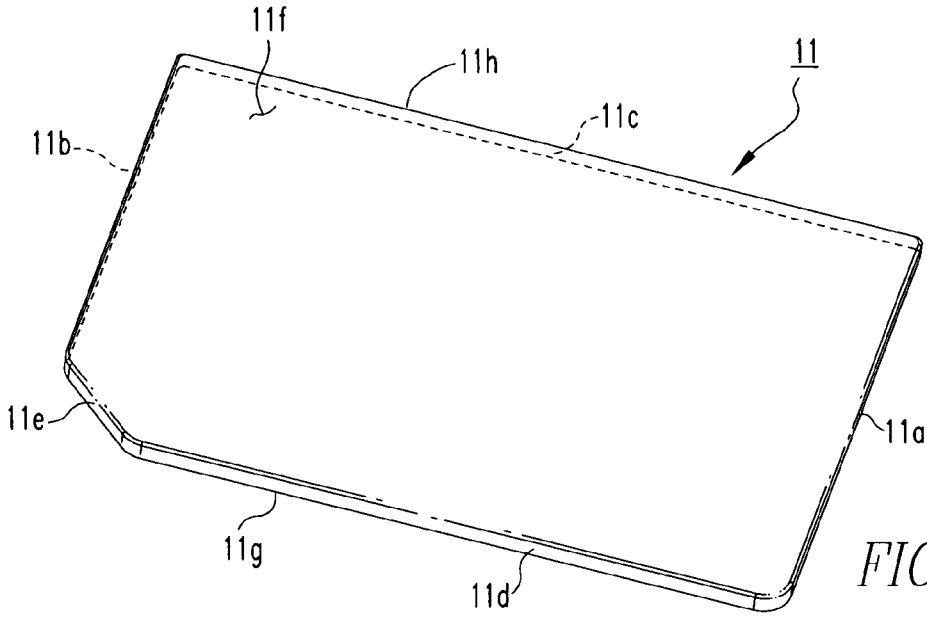
FIG. 3 is a perspective view of a SIM card.

FIG. 3 is a perspective view of the smart card 11 used by the handheld electronic device 4 according to one embodiment. Smart card 11 is substantially rectangular in shape and includes a leading end 11*a*, a trailing end 11*b*, a first side 11*c*, and a second side 11*d*. The smart card 11 includes a top surface 11*f* and a bottom surface 11*g* and may further include an orientation key 11*e* to facilitate orientation of the smart card 11 during assembly. The smart card 11 may include one or more electrical contacts (not shown). The smart card 11 is generally rigid and may be constructed from any suitable material.

Figure 4:
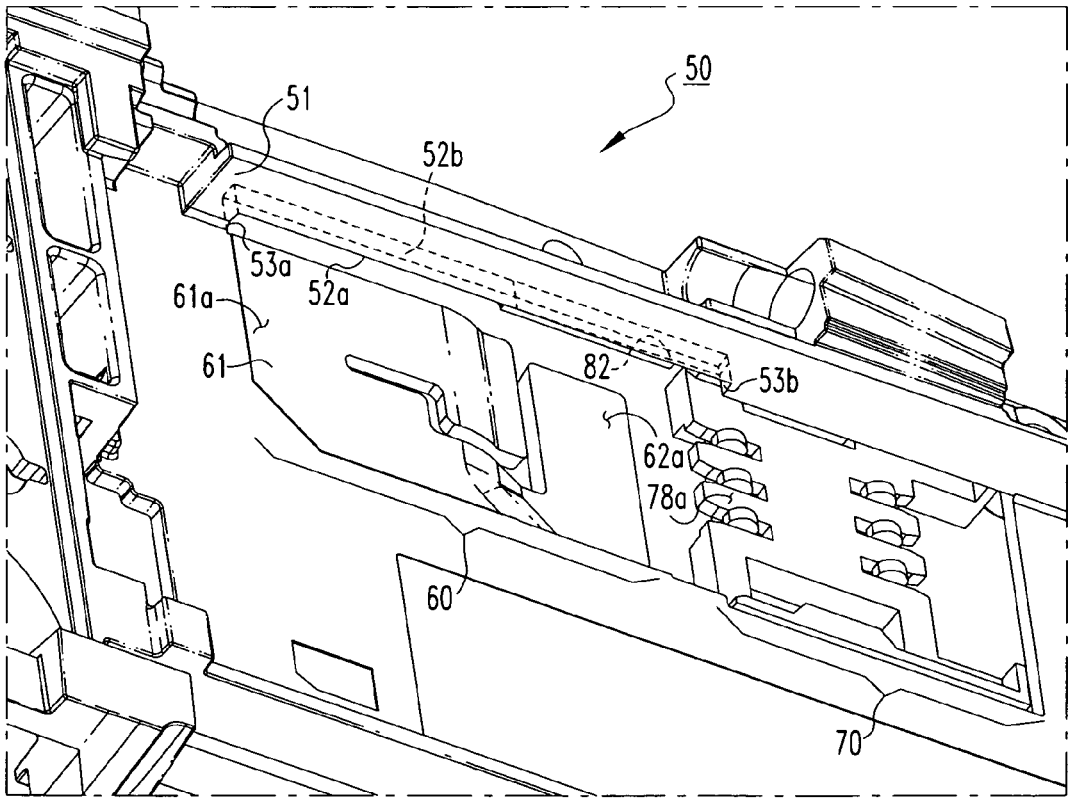
FIG. 4 is a perspective view of a smart card holder frame of the improved handheld device of FIG. 1.

FIG. 4 illustrates a smart card holder frame 50 for the handheld electronic device 4. The smart card holder frame 50 includes an alignment structure 60 and a card holder 70 integrated therein and is of unitary construction, however, it may be advantageous that the smart card holder frame 50 be of non-unitary construction. The frame 50 also includes a member 51, which as seen in FIG. 4, may obstruct an observer's view of a portion of the card holder 70 and the alignment structure 60.

Figure 5A:
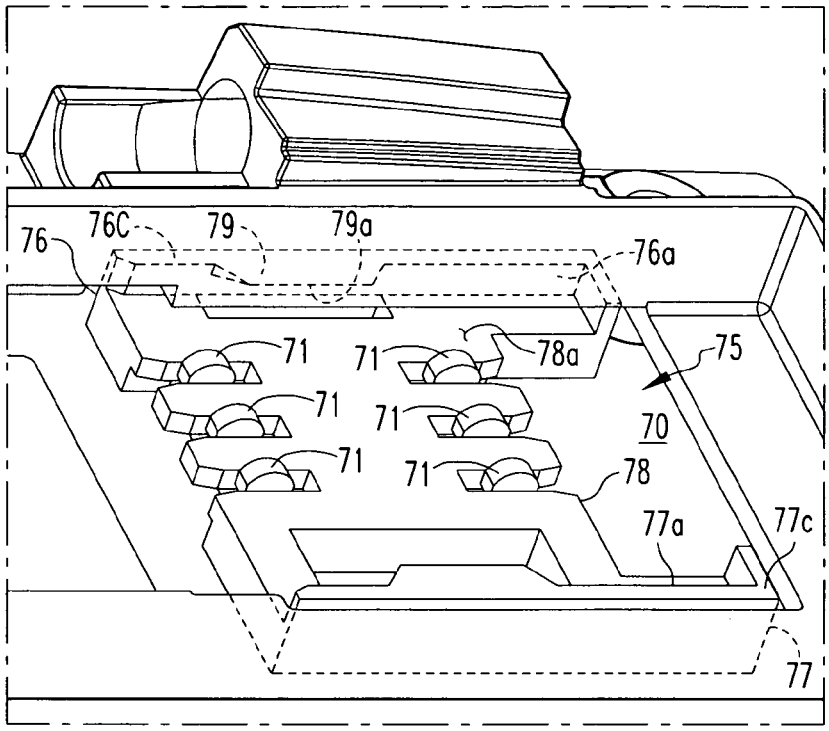
FIG. 5A is a detailed perspective view of a card holder portion of the smart card holder frame of FIG. 4.
Figure 5B:
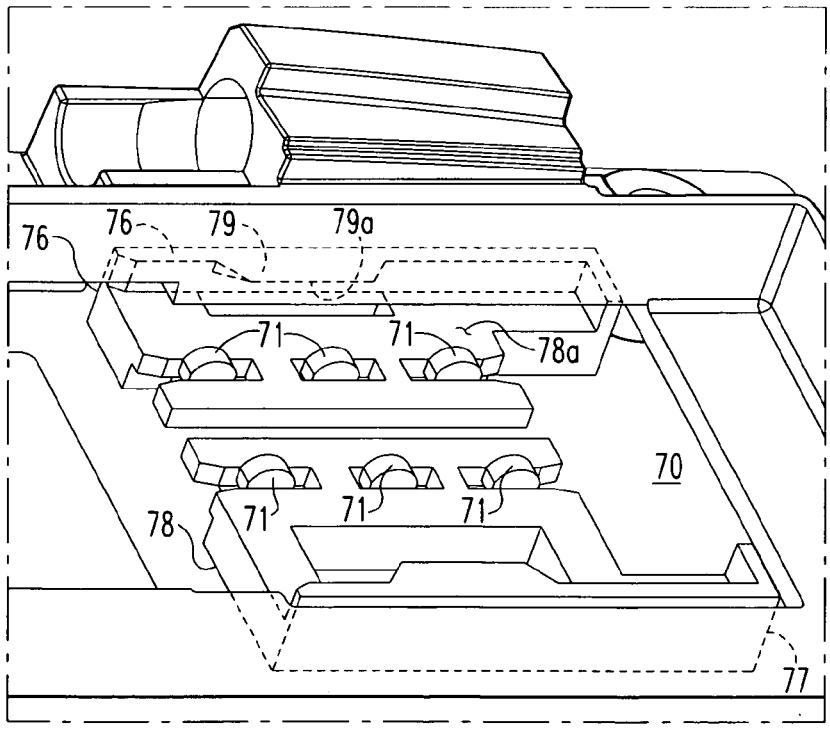
FIG. 5B is a detailed perspective view of the card holder portion of the smart card holder frame of FIG. 4 according to an alternative embodiment.

FIG. 5A is a detailed view of the card holder 70 which has a first wall 76 and a second wall 77. The second wall 77 has an inner surface 77*a* that is oriented parallel to and in opposition to an inner surface 76*a* of the first wall 76. The card holder 70 may also include a base 78 disposed between and separating the first wall 76 and second wall 77. As shown in FIG. 5A, the first wall 76, second wall 77, and base 78 are of unitary construction, however, it may be advantageous that the first wall 76, second wall 77, and base 78 be of non-unitary construction. For example, the base portion may be integrated into the bottom of the first wall 76 and into the bottom of the second wall 77 to form L-shaped channels (as shown in FIG. 5B) or to form C-shaped channels (not shown), or the base 78 may be disconnected from the first wall 76 and second wall 77 (not shown), among others.

The first wall 76 may have one or more connector clips 79 protruding therefrom. Likewise, the second wall 77 may have one or more connector clips 79 protruding therefrom. The card holder 70 has an open region 75 disposed between the inner surface 76*a* of the first wall 76, the inner surface 77*a* of the second wall 77, a top surface 78*a* of the base 78, and a bottom surface 79*a* of each of the connector clips 79. The open region 75 is configured to slidingly receive the smart card 11.

Base 78 also includes one or more spring members 71 protruding outwardly from the top surface 78*a* thereof. In the current embodiment, the spring members 71 function in combination with the connector clips 79 on the first and second walls (76, 77) when a smart card 11 is slidingly received within the open region 75. More specifically, the spring members 71 are configured to bias the smart card 11 towards the connector clips 79 (e.g., to bias the top surface 11*f* of the smart card 11 into engagement with the bottom surfaces 79*a* of the connector clips 79). The spring members 71 may also function as electrical contacts which are electrically connectable with associated contacts (not shown) on the smart card 11 when the smart card is received in the open region 75, although the card holder 70 may employ separate spring members 71 and electrical contacts while remaining within the scope of the present invention. The electrical contacts of the base 78 are electrically connected with the processor 16 such that the processor 16 can interface with an assembled smart card 11.

Figure 6:
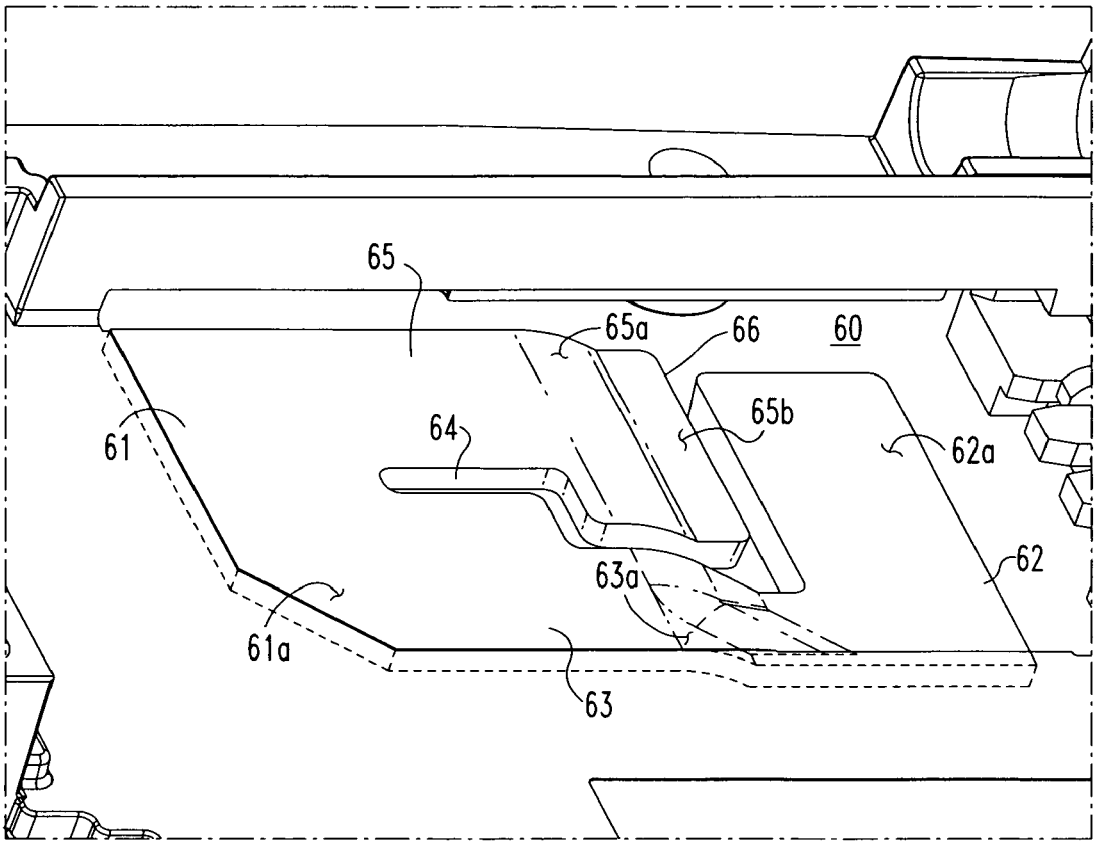
FIG. 6 is a detailed perspective view of an alignment structure portion of the smart card holder frame of FIG. 4.

FIG. 6 is a detailed view of the alignment structure 60. The alignment structure 60 includes an upper region 61 which transitions into two prongs 63, 65 separated by a gap 64. The first prong 63 is referred to herein as lower support 63, whereas the second prong 65 is referred to herein as deflectable finger 65. The lower support 63 transitions into a lower region 62 via a first transition portion 63*a*. Deflectable finger 65 transitions (relative to upper region 61) into a lower portion 65*b* via a second transition portion 65*a*. The lower portion 65*b* of deflectable finger 65 terminates in edge 66, which aids in retaining an assembled smart card 11 as will be discussed in greater detail below.

Returning to FIG. 4, the top surface 62*a* of the lower region 62 is substantially coplanar with the top surface 78*a* of base 78. The upper region 61 and the portion of the lower support 63 disposed between the upper region 61 and the transition portion 63*a* together have a unitary and substantially planar surface 61*a*, which is slightly elevated (from the perspective of FIG. 4) relative to a top surface 62*a* of the lower region 62 and the top surface 78*a* of base 78. A portion of the deflectable finger 65 disposed between the upper region 61 and the transition portion 65*a* however, is slightly elevated relative to planar surface 61*a*. The deflectable finger 65, if deflected generally in the direction of the arrow 95 in FIG. 6, may act as a spring to bias the smart card 11 as will be discussed in more detail below.

As mentioned above, the member 51 may obstruct an observer's view of a portion of the card holder 70 and/or the alignment structure 60. More specifically (and as best seen in FIG. 4), member 51 may obstruct the view of the card holder first wall 76, including its inner surface 76*a* and top surface 76*c*. Additionally, the view of the connector clip 79 protruding from the first wall 76 may also be obstructed. As a result, alignment of a smart card 11 with the card holder open region 75 during assembly may prove to be difficult. Accordingly, a guide 80 (as seen in FIG. 7) is provided on the member 51 to aid alignment of the smart card during assembly and to facilitate grasping the smart card during disassembly.

In the current embodiment, member 51 includes a recess 52 which begins at a first end 53*a* and terminates at a notch 53*b*. The recess 52 is advantageously sized to allow insertion of a side (e.g., first side 11*c*) of the smart card 11. The recess 52 includes a top surface 52*a* and a back surface 52*b*. The back surface 52*b*, which is substantially perpendicular with the top surface 52*a*, is aligned with the inner surface 76*a* of the first wall 76 of the card holder 70. When engaged with the back surface 52*b*, the smart card first side 11*c* is advantageously substantially aligned with the inner surface 76*a* of the first wall 76. In such a situation, the smart card second side 11*d* is similarly substantially aligned with the inner surface 77*a* of the second wall 77.

Figure 7:
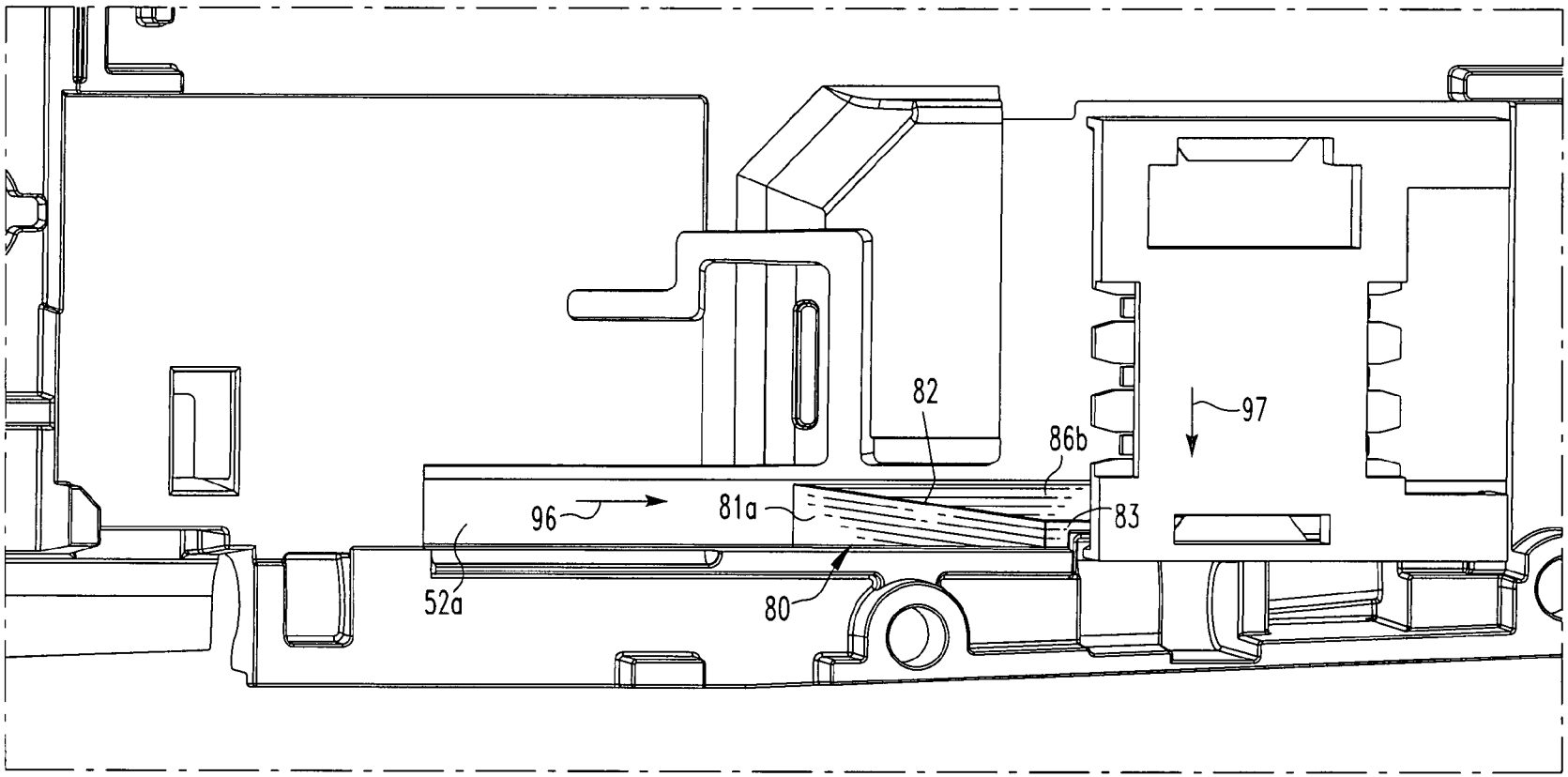
FIG. 7 is a bottom perspective, cutaway view of a portion of the card holder frame of the improved handheld device of FIG. 1.

As best illustrated in FIG. 7 (which is a perspective-cutaway view of from the bottom), top surface 52*a* has guide 80 disposed thereon. Guide 80 includes a first sloped surface 81*a* and a second sloped surface 81*b* which share a common edge 82 and which converge into a flat surface 83. When traveling along the top surface 52*a* from first end 53*a* toward the notch 53*b* (as indicated generally by directional arrow number 96 in FIG. 7), the first sloped surface 81*a* extends and angles away from the top surface 52*a* towards flat surface 83. Traveling towards the back surface 52*b* from the outside of recess 52 (as indicated generally by directional arrow number 97 in FIG. 7), the second sloped surface 81*b* extends and angles away from the top surface 52*a* towards the flat surface 83.

The smart card 11 engaged with the first sloped surface 81*a* and/or the second sloped surface 81*b* (during assembly for example) is directed toward the flat surface 83. Flat surface 83 is aligned with, and substantially coplanar with, the bottom surfaces 79*a* of the connector clips 79 on the first and second walls (76, 77) of the card holder 70. As a result, a smart card 11 engaged with flat surface 83 is substantially aligned with the bottom surfaces 79*a* of the connector clips 79.

Figure 8:
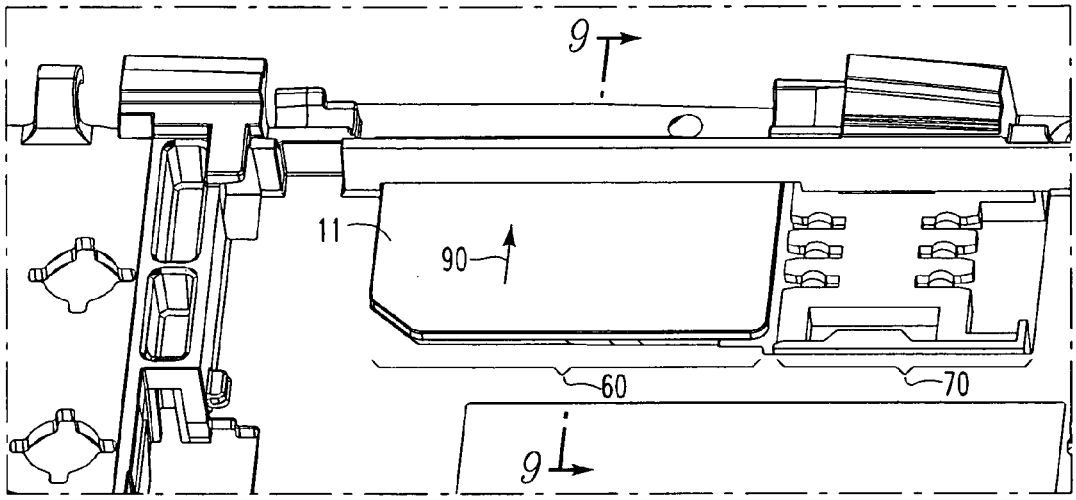
FIGS. 8–10 illustrate assembly of a smart card into the smart card holder frame of the improved handheld device.
Figure 10:
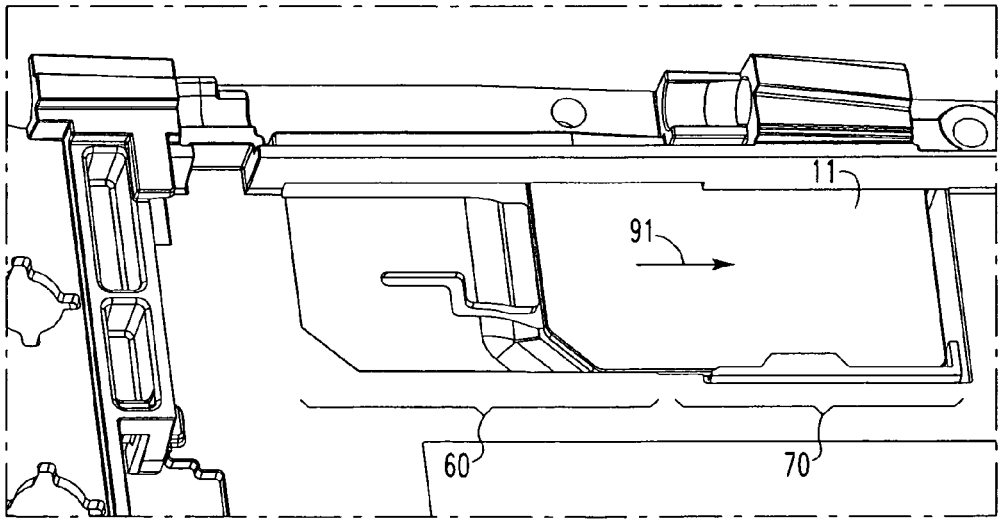

FIGS. 8–10 illustrate the assembly of the smart card 11 into the smart card holder frame 50 of the improved hand-held device 4. FIG. 8 illustrates a perspective view of the partially assembled smart card 11. As seen in FIG. 8, the first side 11*c* of the smart card 11 is received in the recess 52 of the frame 50 and is engaged with the back surface 52*b* (as generally indicated by the directional arrow 90). Thus, the first side 11*c* is substantially aligned with the card holder first wall inner surface 76*a* and the second side 11*d* is substantially aligned with the card holder second wall inner surface 77*a*. Although not shown in FIG. 9, a force is applied to the smart card top surface 11*f*, such as near the second side 11*d*, to deflect the deflectable finger 65. During assembly, this force may be applied by a user while simultaneously inserting the smart card 11 into recess 52.

Figure 9A:
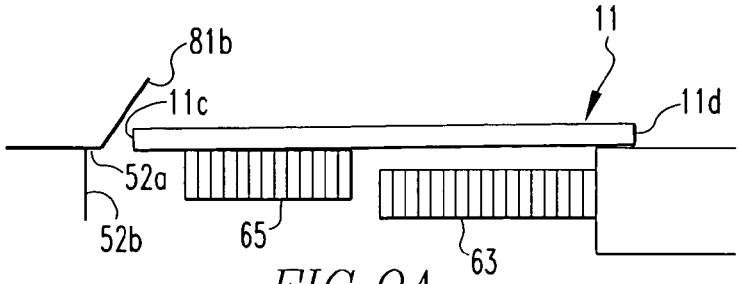

FIGS. 9A–9D illustrate the steps that may be applied to obtain the partially assembled smart card 11 as illustrate in FIG. 8. Referring to FIG. 9A, the smart card 11 is placed on the alignment structure such that it rests on the portion of the deflectable finger 65 (i.e., between the upper region 61 and the transition portion 65*a*) that is slightly elevated relative to the lower support 63. Portions of the smart card 11 may rest on another portion of the frame 50.

Figure 9B:
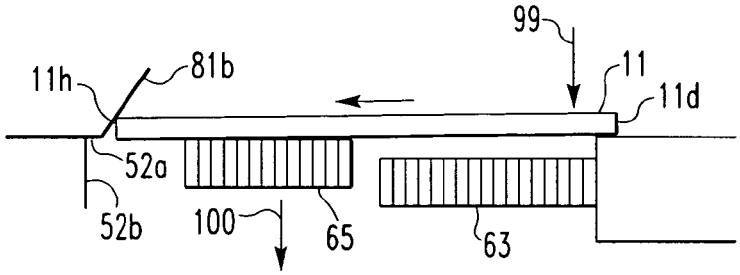

Referring to FIG. 9B, the smart card 11 is moved such that an edge 11*h* between the top surface 11*f* and the first side 11*c* engages the second sloped surface 81*b*. Engagement of the second sloped surface 81*b*, in combination with the bias created by the deflectable finger 65, causes a torque on the smart card 11. This torque biases the second side 11*d* upward (as best illustrated by directional arrow 98 in FIG. 9D). Accordingly, a downward force (as shown by directional arrow 99 in FIG. 9C) is applied by the user during assembly to counteract this torque. The downward force causes the deflectable finger 65 to deflect downward (as indicated by directional arrow 100 in FIG. 9C).

Figure 9C:
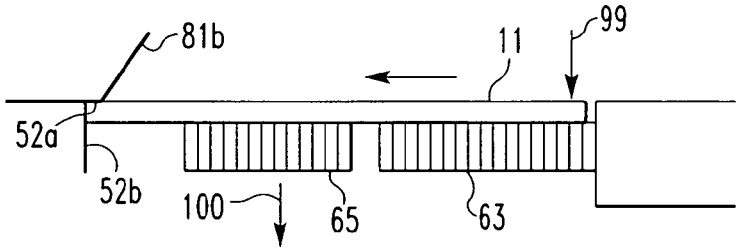

Referring to FIG. 9C, the smart card 11 is pushed further into recess 52, towards the back surface 52*b*. The edge 11*h* of the smart card 11 disengages from the second sloped surface 81*b*, and at least a portion of the top surface 11*f* engages the top surface 52*a* of member 52. It should be noted that a portion of the first side 11*c* and/or a portion of the leading end 11*a* also engage the first sloped surface 81*b*. Application of the downward force to the second side 11*d* continues to counteract the torque on the smart card 11 and to further deflect the deflectable finger 65. As seen in FIG. 9C, the top surface of the deflectable finger 65 is substantially parallel with the flat surface on the portion of the lower support 63 (i.e., between the upper region 61 and the transition portion 63*a*) and the upper region 61. Furthermore as seen in FIG. 9*c*, the smart card 11 is no longer resting on the other portion of the frame 50 and is instead resting on the lower support 63 (and the upper region 61, not shown). In this position, the smart card 11 is aligned with the open region 75 between the inner surfaces 76*a* and 76*b* of the first and second walls 76 and 77, and thus is aligned in a horizontal plane (from the perspective of FIG. 9C).

Next, the smart card 11 is moved towards the card holder 70 (as generally indicated by the directional arrow 91 in FIG. 10). The movement of the smart card 11 towards card holder 70 causes the portion of the leading end 11*a* that is in engagement with the first sloped surface 81*a* to be moved away from the top surface 52*a* of the recess 52 and towards the flat surface 83. Although only a portion of the smart card leading end 11*a* engages the first sloped surface 81*a*, the entire leading end 11*a* is moved as a rigid whole due to the rigidity of the smart card 11.

It should be noted that this movement of the leading end 11*a* toward the flat surface 83 causes the smart card leading end 11*a* to pitch slightly downward (i.e., away from top surface 52*a*). This downward pitching motion may encounter some resistance should the smart card trailing end 11*b* pitch upward about a pivot that is formed, for example, at the deflectable finger 65. The resistance may be caused by an increase in the contact force between the smart card trailing end 11*b* and the recess upper surface 52*a*. It should be realized that by applying a continuous downward force on deflectable finger 65 (e.g., by a user pushing down on the smart card 11 while simultaneously inserting the smart card 11) an advantageous reduction in the contact force between the smart card trailing end 11*b* and the recess upper surface 52*a* may be obtained.

As the smart card 11 continues towards the card holder 70, the leading end 11*a* rides over the flat surface 83 such that the smart card top surface 11*f* is in contact with the flat surface 83. As discussed above, flat surface 83 is aligned with, and substantially coplanar with, the bottom surfaces 79*a* of the connector clips 79 on the first and second walls (76, 77) of the card holder 70. As a result, the smart card top surface 11*f* is also substantially aligned with and coplanar with the bottom surfaces 79*a* of the connector clips 79 protruding from the first and second walls (76, 77) of the card holder 70 (i.e., the smart card 11, which is aligned between the bottom surfaces 79*a* and the top surface 78*a* of the base 78, can be said to be in alignment with the open region 75 in a vertical direction from the perspective of FIG. 9). Since the smart card 11 is aligned with the open region 75 in both the vertical and horizontal directions from the perspective of FIG. 9C, the smart card 11 can be said to be aligned with the open region 75. Therefore, further motion of the smart card 11 towards the card holder 70 allows the smart card 11 to enter the open space of the card holder 70 (i.e., the card holder 70 slidingly receives the smart card 11). It should be noted that additional vertical clearance may be provided to the open space to facilitate assembly of the smart card 11. Once fully assembled, however, the spring members 71 bias the smart card 11 towards the connector clips 79 to cause the top surface 11*f* of the smart card 11 to engage the bottom surfaces 79*a* of the connector clips 79.

Once the smart card trailing end 11*b* passes the deflectable finger edge 66 (e.g., once the smart card 11 is received within the card holder 70), the deflectable finger 65 returns to its free state (i.e., it is no longer deflected). At this point, the deflectable finger edge 66 is engageable with the smart card trailing end 11*b* to resist the smart card 11 from disengaging from the card holder 70.

Figure 11:
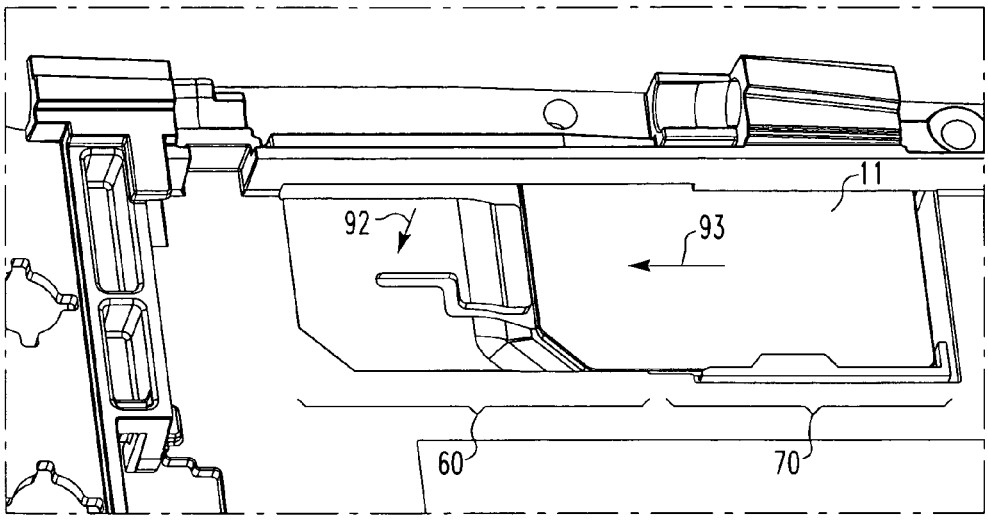
FIGS. 11–12 illustrate disassembly of a smart card from the smart card holder frame of the improved handheld device.
Figure 12:
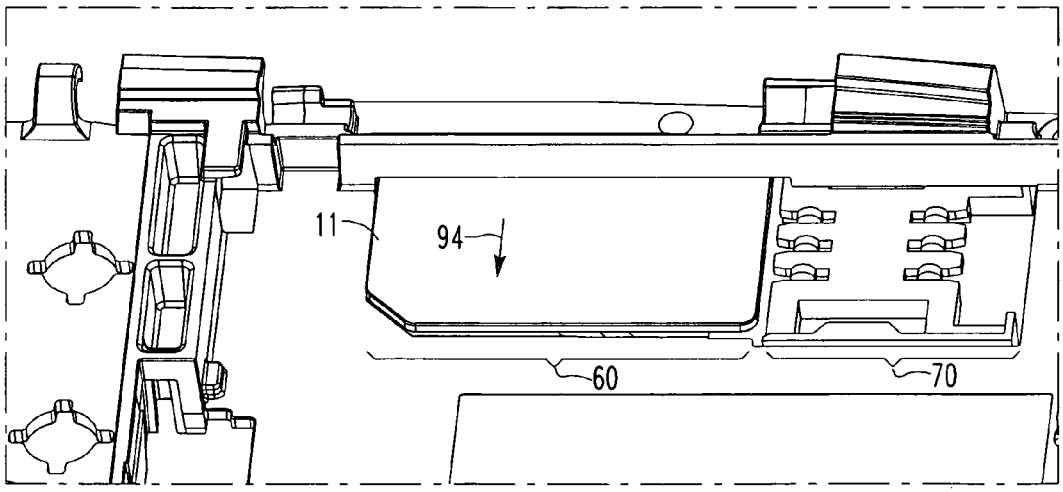

FIGS. 11–13 illustrate the disassembly of the smart card 11 from the smart card holder frame 50 of the improved handheld device 4. The deflectable finger 65 is deflected (i.e., flexed downward as generally indicated by the directional arrow 92 in FIG. 11) such that the deflectable finger edge 66 is clear of the trailing end 11*b*. Once clear, the smart card 11 is moved such that it slides away from the card holder 70 towards the alignment structure 60 (as generally indicated by the directional arrow 93 in FIG. 11). The smart card bottom surface 11*g* travels over and is disposed on the lower region 62.

As the smart card 11 is moved further, the trailing end 11*b* engages and follows the contour of the deflectable finger transition portion 65*a* and/or the contour of the lower support transition portion 63*a*. The deflectable finger transition portion 65*a* and/or the lower support transition portion 63*a* cause the trailing end 11*b* to pitch upwards.

Additionally, a pivot (as discussed above) may be formed while the smart card 11 is being disassembled. The pivot may cause the smart card 11 to encounter some resistance to the movement towards the alignment structure 60. The resistance may be caused by an increase in the contact force between, for example, the smart card leading end 11*a* and the base top surface 78*a*. As the smart card 11 is moved farther, a portion of the trailing end 11*b* (e.g., near the corner where the trailing end 11*b* and the first side end 11*c* meet) may come into contact with flat surface 83, first sloped surface 81*a*, and/or the recess top surface 52*a*. Contact with the flat surface 83, the first sloped surface 81*a*, and/or the recess top surface 52*a* may cause additional resistance to a movement of the smart card 11 towards the alignment structure 60. It should be realized that a downward force exerted on smart card top surface 11*f* (e.g., by a user pushing down on the smart card 11 while simultaneously sliding the smart card 11) may deflect deflectable finger 65 and cause an advantageous reduction in the contact force between the smart card leading end 11*a* and the base top surface 78*a*, and/or between the trailing end 11*b* and the flat surface 83, the first sloped surface 81*a*, and/or the recess top surface 52*a*.

The upward pitching of the trailing end 11*b* by the deflectable finger transition portion 65*a* and/or the lower support transition portion 63*a* permits the trailing end 11*b* of the smart card 11 to be easily grasped by a user. As a result, the user may continue to apply the aforementioned downward force to the smart card 11 while simultaneously pulling on the smart card 11. Thus, resistance encountered during disassembly may be more readily overcome.

Figure 9D:
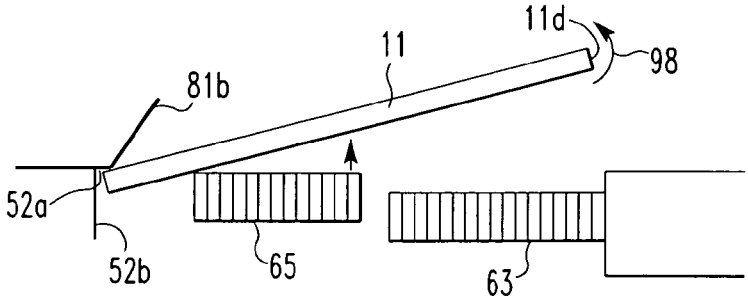

At this point in the disassembly, the smart card 11 remains inserted inside recess 52 (i.e., the first side 11*c* is adjacent with the back surface 52*b*) and the deflectable finger 65 remains deflected (for example as illustrated in FIG. 9C). If the downward force applied to the smart card 11 is removed, the deflectable finger 65 returns to its free state. Because the first side 11*c* is in engagement with the top surface 52*a* and/or the second sloped surface 81*b*, the second side 1*d* to rotates upward (as shown in FIG. 9D) when the deflectable finger returns to its free state. The smart card 11 is thus "presented" for easy removal from the smart card holder frame 50 and the entire handheld device 4 does not need to be inverted to have the smart card 11 fall out of the recess 52.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A smart card holder frame for an electronic device, comprising:

a card holder having a base, a first wall, a second wall, a connector clip, and an open region structured to receive a smart card therein, said open region being disposed between said base, said first wall, said second wall, and said connector clip;

a member having a first sloped surface and a second sloped surface structured to be engaged with a smart card and to align said smart card with said open region; and an alignment structure comprising a deflectable finger that is structured to bias said smart card into engagement with at least one of said first sloped and said second sloped surface, wherein said alignment structure is adjacent said card holder and wherein said member is adjacent said card holder and said alignment structure.

2. The smart card holder frame of claim 1 wherein said member includes a recess with a top surface having said at least one of said first sloped surface and said second sloped surface being disposed in the recess.

3. The smart card holder frame of claim 2 wherein said recess includes a back surface, said back surface being structured to engage said smart card and to align said smart card between said first and second walls.

4. The smart card holder frame of claim 3 wherein at least one of said sloped surfaces is structured to slidingly engage said smart card to align said smart card between said base and said connector clip.

5. The smart card holder of claim 1 wherein said alignment structure includes a base structured to receive said smart card thereon when said smart card is engaged with one of the first sloped surface and the second sloped surface and said finger is in a deflected condition, said finger being disposed adjacent the base and biasing the smart card away from said base.

6. The smart card holder frame of claim 1 wherein an inner surface of said second wall is oriented parallel to and in opposition to an inner surface of said first wall and wherein said base is disposed between said first wall and said second wall.

7. The card holder frame of claim 1 wherein said sloped surfaces converge into a flat surface, said flat surface being substantially coplanar with a bottom surface of said connector clip.

8. The smart card holder frame of claim 1 wherein said alignment structure includes a lower region, at least a portion of a top surface of said lower region oriented substantially coplanar with a top surface of said base.

9. The smart card holder frame of claim 1 wherein said base includes one or more contacts structured to be electrically connectable with one or more contacts on said smart card.

10. The smart card holder frame of claim 9 wherein said base includes one or more spring members configured to bias said smart card towards said connector clip.

11. The smart card holder frame of claim 10 wherein said contacts are on said springs.

12. The smart card holder frame of claim 1 wherein said finger in a free state is structured to be engageable with said smart card to resist sliding disengagement of said smart card from said open region.

13. A handheld electronic device comprising:

a processor unit having a processor, an input apparatus, an output apparatus, and a memory including a smart card; and a housing adapted to carry said processor unit, said housing including a smart card holder frame, said smart card holder frame comprising:

a card holder having a base, a first wall, a second wall, a connector clip, and an open region structured to receive a smart card therein, said open region being disposed between said base, said first wall, said second wall, and said connector clip;

a member having a first sloped surface and a second sloped surface structured to be engaged with a smart card and to align said smart card with said open region; and an alignment structure comprising a deflectable finger that is structured to bias said smart card into engagement with at least one of said first sloped and said second sloped surface, wherein said alignment structure is adjacent said card holder and wherein said member is adjacent said card holder and said alignment structure.

14. The handheld electronic device of claim 13 wherein said member includes a recess with a top surface having said at least one of said first sloped surface and said second sloped surface being disposed in the recess.

15. The handheld electronic device of claim 14 wherein said recess includes a back surface, said back surface being structured to engage said smart card and to align said smart card between said first and second walls.

16. The handheld electronic device of claim 15 wherein at least one of said sloped surfaces is structured to slidingly engage said smart card to align said smart card between said base and said connector clip.

17. The handheld electronic device of claim 13 wherein said alignment structure includes a base structured to receive said smart card thereon when said smart card is engaged with one of the first sloped surface and the second sloped surface and said finger is in a deflected condition, said finger being disposed adjacent the base and biasing the smart card away from said base.

18. The handheld electronic device of claim 13 wherein an inner surface of said second wall is oriented parallel to and in opposition to an inner surface of said first wall and wherein said base is disposed between said first wall and said second wall.

19. The handheld electronic device of claim 13 wherein said sloped surfaces converge into a flat surface, said flat surface being substantially coplanar with a bottom surface of said connector clip.

20. The handheld electronic device of claim 13 wherein said alignment structure includes a lower region, at least a portion of a top surface of said lower region oriented substantially coplanar with a top surface of said base.

21. The handheld electronic device of claim 13 wherein said base includes one or more contacts structured to be electrically connectable with one or more contacts on said smart card.

22. The handheld electronic device of claim 21 wherein said base includes one or more spring members configured to bias said smart card towards said connector clip.

23. The handheld electronic device of claim 22 wherein said contacts are on said springs.

24. The handheld electronic device of claim 13 wherein said finger in a free state is structured to be engageable with said smart card to resist sliding disengagement of said smart card from said open region.

* * * * *